US009127839B2

(12) United States Patent
Tanaka et al.

(10) Patent No.: US 9,127,839 B2
(45) Date of Patent: Sep. 8, 2015

(54) COMBUSTION APPARATUS

(71) Applicant: Rinnai Corporation, Aichi (JP)

(72) Inventors: Fumio Tanaka, Aichi (JP); Kazuyuki Akagi, Aichi (JP); Hideo Okamoto, Aichi (JP)

(73) Assignee: RINNAI CORPORATION, Aichi (JP)

( * ) Notice: Subject to any disclaimer, the term of this patent is extended or adjusted under 35 U.S.C. 154(b) by 321 days.

(21) Appl. No.: 13/708,105

(22) Filed: Dec. 7, 2012

(65) Prior Publication Data

US 2013/0164697 A1 Jun. 27, 2013

(30) Foreign Application Priority Data

Dec. 27, 2011 (JP) ..... 2011-284782
Nov. 19, 2012 (JP) ..... 2012-252866

(51) Int. Cl.

| | |
|---|---|
| ***F23C 7/00*** | (2006.01) |
| ***F23M 20/00*** | (2014.01) |
| *F23L 1/00* | (2006.01) |
| *F23M 9/02* | (2006.01) |

(52) U.S. Cl.

CPC ..... *F23M 99/005* (2013.01); *F23M 20/005* (2015.01)

(58) Field of Classification Search

CPC ..... F23M 99/005; F23M 20/005; F23M 9/02; F23M 9/04; F23C 7/008; F23L 1/00; F23L 5/02; F23L 7/005
USPC ..... 431/114, 12; 126/516, 521, 110 R, 112
IPC ..... F23L 1/00, 5/02; H01M 6/14; F23C 7/00; F23M 9/02

See application file for complete search history.

(56) References Cited

U.S. PATENT DOCUMENTS

| | | | | | |
|---|---|---|---|---|---|
| 518,054 | A | * | 4/1894 | Craney | 110/297 |
| 3,723,049 | A | * | 3/1973 | Juricek | 431/183 |
| 3,947,226 | A | * | 3/1976 | Neumann et al. | 431/114 |
| 4,023,921 | A | * | 5/1977 | Anson | 431/9 |
| 4,168,948 | A | * | 9/1979 | Okamoto et al. | 431/114 |
| 4,922,889 | A | * | 5/1990 | Nuesmeyer et al. | 126/73 |

(Continued)

FOREIGN PATENT DOCUMENTS

| | | | |
|---|---|---|---|
| JP | 64-003960 | Y2 | 2/1989 |
| JP | 01-129556 | U | 9/1989 |
| JP | 02-029505 | A | 1/1990 |
| JP | 04-018208 | B2 | 3/1992 |
| JP | 05-296442 | A | 11/1993 |

(Continued)

*Primary Examiner* — Gregory Huson
*Assistant Examiner* — Daniel E Namay
(74) *Attorney, Agent, or Firm* — Cermak Nakajima & McGowan LLP; Tomoko Nakajima

(57) ABSTRACT

A combustion apparatus has a burner, a combustion box containing therein a heat exchanger, an exhaust passage in fluid communication with the combustion box, a fan for supplying the burner with combustion air, and a predetermined length of air suction duct in fluid communication with a suction opening formed in a fan casing. The air suction duct has: on a downstream end thereof, an outlet cylindrical portion which is smaller in diameter than a diameter of the suction opening in the fan casing and which lies opposite to the suction opening; and a flange portion which overhangs radially outward from a perimeter of the air suction duct adjacent to the outlet cylindrical portion into contact with that peripheral portion of the fan casing which forms the suction opening. The flange portion is provided with an auxiliary suction opening in fluid communication with a space surrounding the outlet cylindrical portion.

5 Claims, 4 Drawing Sheets

(56) References Cited

U.S. PATENT DOCUMENTS

| | | | | | |
|---|---|---|---|---|---|
| 5,580,238 | A | * | 12/1996 | Charles et al. | 431/114 |
| 5,664,412 | A | * | 9/1997 | Overton | 60/39.23 |
| 6,428,312 | B1 | * | 8/2002 | Smelcer et al. | 431/329 |
| 2007/0248921 | A1 | * | 10/2007 | Takasu et al. | 431/29 |
| 2013/0164697 | A1 | * | 6/2013 | Tanaka et al. | 431/114 |

FOREIGN PATENT DOCUMENTS

| | | | | |
|---|---|---|---|---|
| JP | 09-126513 | A | | 5/1997 |
| JP | 10-47723 | A | | 2/1998 |
| JP | 2000-161650 | A | | 6/2000 |
| JP | 2013130301 | A | * | 7/2013 |
| JP | 2013152066 | A | * | 8/2013 |

* cited by examiner

COMBUSTION APPARATUS

BACKGROUND OF THE INVENTION

1. Field of the Invention

The present invention relates to a combustion apparatus which is provided with a burner, a combustion box containing therein a heat exchanger which is heated by combustion gas from the burner, an exhaust passage in fluid communication with the combustion box, and a fan for supplying the burner with combustion air.

2. Description of the Related Art

This kind of combustion apparatus is likely to give rise to low-frequency resonant sounds below 100 Hz. This is due to the fact that an open pipe equivalent length (the length corresponding to an open pipe whose both ends are free ends) from a suction opening formed in a fan casing which houses therein fan impellers to an exhaust port on a downstream end of the exhaust passage becomes the length that corresponds to a multiple of half wavelength of frequency components below 100 Hz that are contained in the combustion noises generated by combustion vibrations, thereby giving rise to acoustic vibrations of these frequencies.

As a solution to this kind of problems, there is known a prior art in which is provided a predetermined length of air suction duct in fluid communication with the suction opening in the fan casing (e.g., see JP-UM-A-1989-129556). According to this arrangement, the substantial suction opening of the fan becomes the inlet on an upstream end of the air suction duct. The open pipe equivalent length from this inlet to the exhaust port thus becomes longer and deviates from a length corresponding to the multiple of half wavelength of the frequency components below 100 Hz contained in the combustion noises. As a result, the acoustic vibrations are suppressed and the low-frequency resonant sounds below 100 Hz can be suppressed. However, if the air suction duct is provided, there will be generated low-frequency resonant sounds in the range of 400 Hz to 800 Hz that did not occur in the case in which the air suction duct is not provided. This is due to the fact that the open pipe equivalent length from the inlet on the upstream side of the air suction duct to the exhaust port becomes the length corresponding to a multiple of half wavelength in the range of 400 Hz to 800 Hz that are contained in the combustion noises, thereby giving rise to the acoustic vibrations of that frequency range.

As a solution to this problem, there is known a prior art in which an auxiliary suction opening is formed in the neighborhood of the downstream end of the air suction duct which is in fluid communication with the suction opening in the fan casing (see, e.g., JP-A-1990-29505). According to this arrangement, the energy pressure of the frequency components that should give rise to acoustic vibrations in the range of 400 Hz to 800 Hz partly escapes from the auxiliary suction opening, thereby suppressing the acoustic vibrations of this frequency range. As a result, different low-frequency resonant sounds below 100 Hz and in the range of 400 Hz to 800 Hz can be suppressed.

However, if the auxiliary suction opening is formed in the air suction duct in the above-mentioned manner, the air from the auxiliary suction opening is sucked in a manner to flow across the suction air flow in the air suction duct. The air from the auxiliary suction opening thus interferes with the suction air flow in the air suction duct. As a result, the flow resistance in the air suction duct becomes higher.

SUMMARY

In view of the above-mentioned points, this invention has a problem of providing a combustion apparatus in which low-frequency resonant sounds of different frequencies below 100 Hz and in the range of 400 Hz to 800 Hz can be suppressed without an increase in the flow resistance in an air suction duct.

In order to solve the above-mentioned problem, according to the invention, there is provided a combustion apparatus comprising: a burner; a combustion box containing therein a heat exchanger which is heated by combustion gas from the burner; an exhaust passage in fluid communication with the combustion box; a fan for supplying the burner with combustion air; and an air suction duct of a predetermined length, the air suction duct being in fluid communication with a suction opening formed in a fan casing which houses therein fan impellers. The air suction duct has: on a downstream end thereof, an outlet cylindrical portion which is smaller in diameter than a diameter of the suction opening in the fan casing and which lies opposite to the suction opening; and a flange portion which overhangs radially outward from an outer circumference portion of the air suction duct adjacent to the outlet cylindrical portion, into contact with that peripheral portion of the fan casing which forms the suction opening. The flange portion is provided with an auxiliary suction opening in fluid communication with a space surrounding the outlet cylindrical portion.

According to the invention, by providing the air suction duct, in the same way as in the above-mentioned examples of the prior art, the following is possible, namely, an open pipe equivalent length from the upstream-end inlet of the air suction duct to the exhaust port which discharges the combustion gases from the burner deviates from a length corresponding to a multiple of half wavelength of the frequency components below 100 Hz contained in the combustion noises. The low-frequency resonant sounds below 100 Hz can thus be suppressed. The pressure energy of the frequency components in the range of 400 Hz to 800 Hz partly escapes out of the auxiliary suction opening, whereby the low-frequency resonant sounds in the range of 400 Hz to 800 Hz can also be suppressed.

In addition, according to the invention, the air from the auxiliary suction opening will be sucked into the suction opening through the space surrounding the outlet cylindrical portion. As a result, the air from the auxiliary suction opening is prevented from interfering with the suction air flow that flows inside the outlet cylindrical portion, whereby the flow resistance in the air suction duct can be prevented from becoming higher.

Preferably, the outlet cylindrical portion is inserted into the suction opening. According to this arrangement, the air from the auxiliary suction opening is effectively and advantageously prevented from interfering with the suction air flow in the air suction duct. In addition, in case the flange portion is in contact with that peripheral portion of the fan casing which forms the suction opening wherein the contact is made by means of an annular wall which is formed in a projecting manner in a peripheral portion of that surface of the flange portion which lies opposite to the fan casing, the following becomes possible. In other words, while the outlet cylindrical portion is free from insertion (i.e., not inserted) into the suction opening, the air from the auxiliary suction opening can be effectively prevented from interfering with the suction air flow in the air suction duct if the distance between a front end of the outlet cylindrical portion and the suction opening is below one half the distance between the fan casing and that surface of the flange portion which lies opposite to the fan casing.

In addition, in case the auxiliary suction opening is closed by clogging with dirt, the low-frequency resonant sounds in the range of 400 Hz to 800 Hz can no longer be suppressed. Therefore, the number of the auxiliary suction opening shall preferably be two or more. According to this arrangement, even if some of the auxiliary suction openings are closed by clogging with dirt, the low-frequency resonant sounds in the range of 400 Hz to 800 Hz can still be suppressed until all of the auxiliary suction openings are closed. In this manner, the redundancy for closing by clogging with dirt is improved.

DETAILED DESCRIPTION OF PREFERRED EMBODIMENTS

Figure 1:
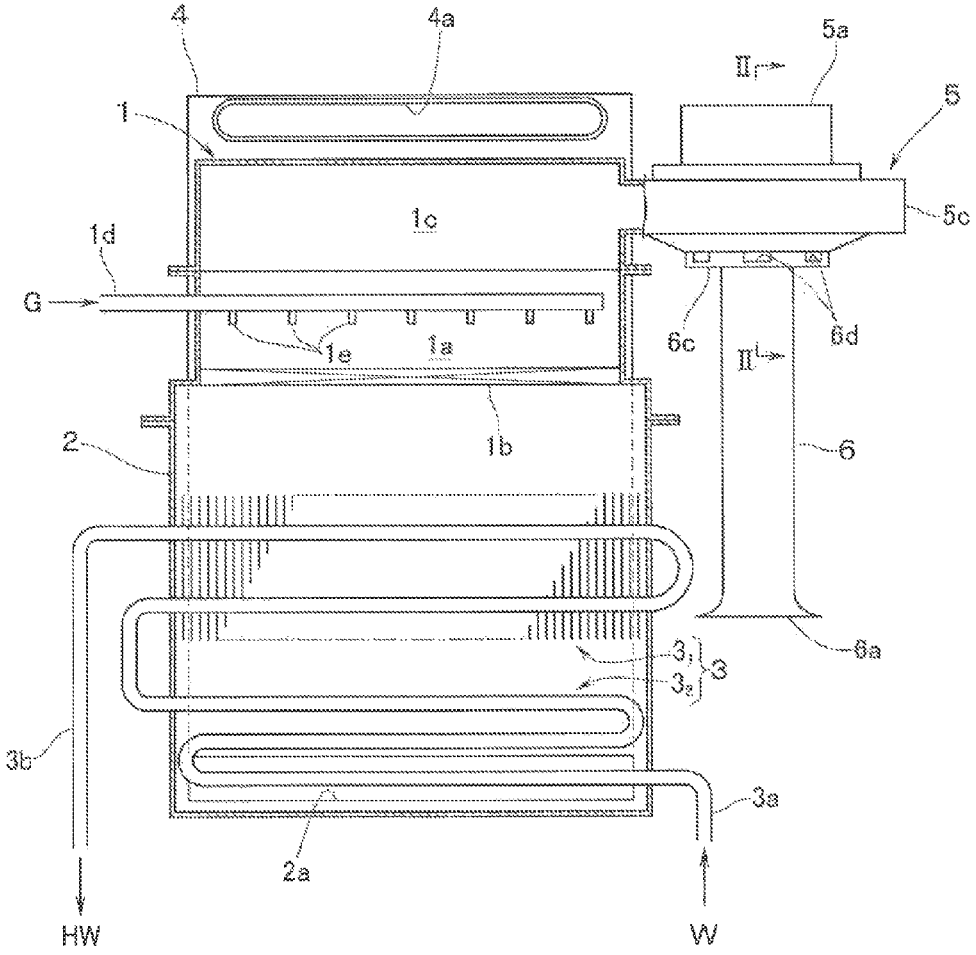
FIG. 1 is a schematic view showing an arrangement of a combustion apparatus according to an embodiment of this invention.

FIG. 1 shows a combustion apparatus having heat source equipment for supplying hot water according to an embodiment of this invention. This combustion apparatus is made up of: a burner 1 on an upper portion of the combustion apparatus; a combustion box 2 which is connected to the bottom of the burner 1 so as to house therein a heat exchanger 3 which supplies hot water by heating with the combustion gas from the burner 1; an exhaust duct 4 which is in fluid communication with the combustion box 2 through an opening 2*a* which is formed in a lower rear portion of the combustion box 2 so as to serve as an exhaust passage which is elongated upward from the opening 2*a*; and a fan 5 which supplies the burner 1 with combustion air.

The heat exchanger 3 has: a first heat exchanger $\mathbf{3}_1$ of sensible heat recovery type which is housed in an upper part of the combustion box 2; and a second heat exchanger $\mathbf{3}_2$ of latent heat recovery type which is housed in a lower part of the combustion box 2. Water W from a water supply pipe 3*a* on an upstream side of the second heat exchanger $\mathbf{3}_2$ is heated in the second heat exchanger $\mathbf{3}_2$ by the latent heat of the combustion gas from the burner 1, and is thereafter heated in the first heat exchanger $\mathbf{3}_1$ by the sensible heat of the combustion gas. It is thus so arranged that hot water HW that is heated to a predetermined set temperature is served to a hot water feed pipe 3*b* on the downstream side of the first heat exchanger $\mathbf{3}_1$. Further, the combustion gas passing through the first heat exchanger $\mathbf{3}_1$ and the second heat exchanger $\mathbf{3}_2$ is discharged outside through the exhaust duct 4 from an exhaust port 4*a* on a downstream end (upper end) of the exhaust duct 4.

The burner 1 has: a mixing chamber 1*a*; a combustion plate 1*b* which is mounted on the lower surface of the mixing chamber 1*a* and which is made of ceramic having a multiplicity of flame holes (not illustrated); and an air supply chamber 1*c* which is on an upper part of the mixing chamber 1*a* in fluid communication therewith. The air from the fan 5 is supplied as primary air for combustion to the mixing chamber 1*a* through the air supply chamber 1*c*. The mixing chamber 1*a* is supplied through a plurality of gas nozzles 1*e* with a fuel gas G from a gas supply passage 1*d*. Then, by controlling the number of rotation of the fan 5 an air-gas mixture (mixture gas of fuel gas and primary air) which is leaner in fuel concentration than a theoretical air-fuel ratio is generated in the mixing chamber 1*a*. This air-gas mixture is ejected from the flame holes of the combustion plate 1*b*, so that fully primary aerated combustion (or totally aerated combustion; i.e., combustion requiring no secondary air) can be effected.

Figure 2:
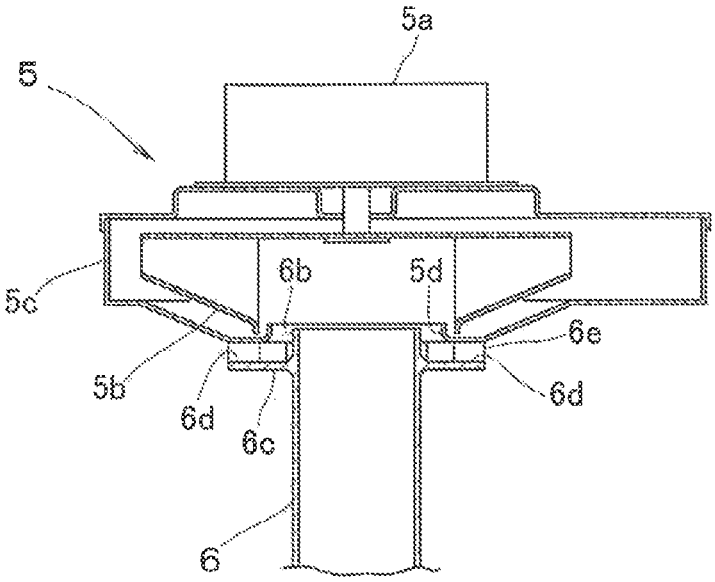
FIG. 2 is a sectional view of a fan and an air suction duct taken along the line II-II in FIG. 1.

With reference to FIG. 2, the fan 5 is made up of a centrifugal fan having impellers 5*b* which are driven for rotation by a motor 5*a*, and a fan casing 5*c* which houses therein the impellers 5*b*. It is to be noted here that, when an open pipe equivalent length from a suction opening 5*d* to be formed in the fan casing 5*c* to the exhaust port 4*a* (i.e., a length corresponding to an open pipe whose both ends are free ends and, in concrete, an actual length from the suction opening 5*d* to the exhaust port 4*a* added by a length equivalent to flow resistances in the combustion plate 1, the heat exchanger 3, and the like) becomes a value corresponding to a multiple of half wavelength of frequency components below 100 Hz that are contained in the combustion noises to be generated in the combustion vibrations, acoustic vibrations of those frequencies are generated, whereby large resonant sounds of low frequencies below 100 Hz are generated.

As a solution, there is provided an air suction duct 6 which is of a predetermined length and which is in fluid communication with the suction opening 5*d*. According to this arrangement, an inlet 6*a* on the upstream end of the air suction duct 6 becomes a substantial suction opening of the fan 5. And the open pipe equivalent length from the inlet 6*a* to the exhaust port 4*a* deviates from the length corresponding to the multiple of half wavelength of those frequency components below 100 Hz which are contained in the combustion noises. The acoustic vibrations of these frequencies are therefore suppressed, and the low-frequency resonant sounds below 100 Hz can thus be suppressed.

However, with the arrangement as it is, the open pipe equivalent length from the inlet 6*a* to the exhaust port 4*a* becomes the length corresponding to a multiple of half wavelength of those frequency components in the range of 400 Hz to 800 Hz which are contained in the combustion noises. Acoustic vibrations of the frequencies of this range will then be generated, thereby giving rise to large acoustic resonant sounds in the range of 400 Hz to 800 Hz.

Figure 3:
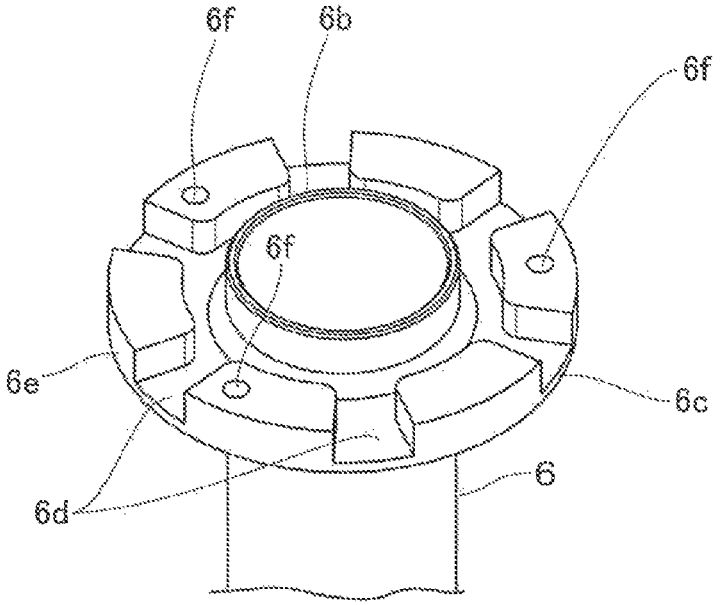
FIG. 3 is a perspective view of an essential part of the air suction duct.

As a solution, the following arrangement has been made in this embodiment as shown in FIGS. 2 and 3. In other words, the air suction duct 6 is provided with: an outlet cylindrical portion 6*b* on a downstream end of the air suction duct 6, the outlet cylindrical portion 6*b* being smaller in diameter than the diameter of the suction opening 5*d* in the fan casing 5*c* and lying opposite to the suction opening 5*d*; and a flange portion 6*c* which overhangs (or which is extended) radially outward from an outer circumference portion of the air suction duct 6 adjacent to the outlet cylindrical portion 6*b*, into contact with that peripheral portion of the fan casing 5*c* which forms the suction opening 5*d*. The flange portion 6*c* has auxiliary suction openings 6*d* which are formed in fluid communication with a space surrounding the outlet cylindrical portion 6*b*. In more detail, the outlet cylindrical portion 6*b* is inserted into the suction opening 5*d*. Further, an annular wall 6*e* is formed in a projecting manner in a peripheral portion of that surface (upper surface) of the flange portion 6*c* which lies opposite to the fan casing 5*c* such that the annular wall 6*e* is in contact with the fan casing 5*c*. A plurality of (six in this embodiment) circumferential portions of this annular wall 6*e* are cut off to thereby form the auxiliary suction openings 6*d* which diametrically penetrate the annular wall 6*e*. The annular wall 6*e* has formed therein mounting holes 6*f* for fixing the flange portion 6*c* to the fan casing 5*c*.

By forming the auxiliary suction openings 6*d* as described above, the pressure energy of the frequency components that are supposed to generate the acoustic vibrations of frequencies in the range of 400 Hz to 800 Hz partly escapes out of the auxiliary suction openings 6*d*, whereby the acoustic vibrations in the range of these frequencies are suppressed. In addition, even if the pressure energy of frequency components below 100 Hz partly escapes out of the auxiliary suction openings 6*d*, the pressure energy of these frequency components is considerably larger than the pressure energy of the frequency components in the range of 400 Hz to 800 Hz. Therefore, the auxiliary suction openings 6*d* will exert little or no effect on the vibration mode of frequencies below 100 Hz and, thanks to the effect by the air suction duct 6, the acoustic vibrations of frequencies below 100 Hz remain suppressed. As a result, it is possible to suppress the different low-frequency resonant sounds below 100 Hz and in the range of 400 Hz to 800 Hz.

Furthermore, according to this embodiment, the air from the auxiliary suction openings 6*d* will be sucked into the suction openings 5*d* through the space surrounding the outlet cylindrical portion 6*b*. Therefore, the air from the auxiliary suction openings 6*d* suppresses the interference with the suction air flow that flows inside the outlet cylindrical portion 6*b*, thereby preventing the flow resistance in the air suction duct 6 from becoming higher.

While the effect of suppressing the different low-frequency resonant sounds below 100 Hz and in the range of 400 Hz to 800 Hz can be obtained even with a single auxiliary suction opening 6*d*, the low-frequency resonant sounds in the range of 400 Hz to 800 Hz can no longer be suppressed if the auxiliary suction opening 6*d* is clogged with dirt. Alternatively, if the auxiliary suction opening 6*d* is provided in two or more in number, the low-frequency resonant sounds in the range of 400 Hz to 800 Hz can still be suppressed even in case where some of the auxiliary suction openings 6*d* are clogged until all of the auxiliary suction openings 6*d* are totally clogged. The redundancy against clogging with dirt can thus be improved.

Figure 4:
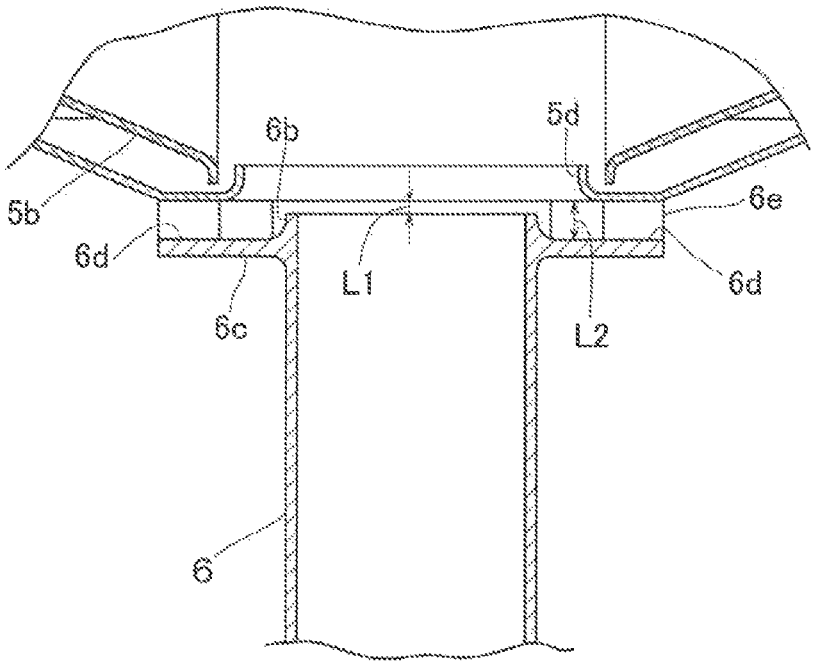
FIG. 4 is a sectional view of an essential part of the fan and the air suction duct according to another embodiment of this invention.

By the way, in this embodiment the outlet cylindrical portion 6*b* is inserted into the suction opening 5*d* so that there can surely be secured suppression of the interference of the air from the auxiliary suction openings 6*d* with the suction air flow in the air suction duct 6. However, the outlet cylindrical portion 6*b* need not always be inserted into the suction opening 5*d*. In other words, as shown in the embodiment of FIG. 4, as long as the distance L1 between the front end of the outlet cylindrical portion 6*b* and the suction opening 5*d* is below one half the distance L2 between the fan casing 5 and that surface of the flange portion 6*c* which lies opposite to the fan casing 5, the interference of the air from the auxiliary suction openings 6*d* with the suction air flow in the air suction duct 6 can be effectively suppressed, whereby the flow resistance in the air suction duct 6 can be prevented from becoming higher.

Description has so far been made of the embodiments of this invention with reference to the accompanying drawings. It is however to be noted that this invention is not limited to the above. For example, in the above-mentioned embodiments, the auxiliary suction openings 6*d* are formed by cutting off part of the annular wall 6*e* that is formed in a projecting manner in the flange portion 6*c* of the air suction duct 6. It is also possible to constitute the auxiliary suction openings by means of holes formed in the annular wall 6*e* in a manner to diametrically penetrate therethrough. Alternatively, auxiliary suction openings may be formed close to that inner circumferential portion of the flange portion 6*c* which lies opposite to the circumferential space of the outlet cylindrical portion 6*b* so as to penetrate in the plate thickness direction of the flange portion 6*c*.

Furthermore, the burner 1 need not be limited to the fully primary aerated combustion burner as in the above-mentioned embodiments but may be a burner which requires the secondary air. Still furthermore, in the above-mentioned embodiments, although this invention was applied to the combustion apparatus which is made up of heat source equipment for supplying hot water, this invention is similarly applicable to a combustion apparatus having a heat exchanger for purposes other than for supplying hot water, such as for heating a living space, and the like.

EXPLANATION OF REFERENCE NUMERALS

1 burner
2 combustion apparatus
3 heat exchanger
4 exhaust duct (exhaust passage)
5 fan
5*b* fan casing
5*d* suction opening
6 air suction duct
6*b* outlet cylindrical portion
6*c* flange portion
6*d* auxiliary suction opening

What is claimed is:

1. A combustion apparatus comprising:
a burner;
a combustion box containing therein a heat exchanger which is heated by combustion gas from the burner;
an exhaust passage in fluid communication with the combustion box;
a fan for supplying the burner with combustion air; and
an air suction duct of a predetermined length, the air suction duct being in fluid communication with a suction opening formed in a fan casing which houses therein fan impellers,
wherein the air suction duct has:
on a downstream end thereof, an outlet cylindrical portion which is smaller in diameter than a diameter of the suction opening in the fan casing and which lies opposite to the suction opening, and
a flange portion which overhangs radially outward from an outer circumference portion of the air suction duct adjacent to the outlet cylindrical portion, into contact with that peripheral portion of the fan casing which forms the suction opening,
wherein the flange portion is provided with an auxiliary suction opening in fluid communication with a space surrounding the outlet cylindrical portion, the auxiliary suction opening formed by a cutout of an annular wall which protrudes from the flange portion in parallel to the axis of the air suction duct, the auxiliary air enters the fan case through the suction opening, the suction opening is co-axial with the air suction duct, and air supplied through the auxiliary suction opening enters into the fan casing.

2. The combustion apparatus according to claim 1, wherein the outlet cylindrical portion is inserted into the suction opening.

3. The combustion apparatus according to claim 1,
wherein the flange portion is in contact with that peripheral portion of the fan casing which forms the suction opening, the contact being made by means of an annular wall which is formed in a projecting manner in a peripheral portion of that surface of the flange portion which lies opposite to the fan casing, and wherein, while the outlet cylindrical portion is free from insertion into the suction opening, a distance between a front end of the outlet cylindrical portion and the suction opening is below one half a distance between the fan casing and that surface of the flange portion which lies opposite to the fan casing.

4. The combustion apparatus according to claim 1, wherein the auxiliary suction opening is two or more in number.

5. The combustion apparatus according to claim 1, wherein the air supplied through the auxiliary suction opening is guided by a cylindrical part of the air suction duct.

* * * * *